US009190011B2

(12) United States Patent
Al-Dahle et al.

(10) Patent No.: US 9,190,011 B2
(45) Date of Patent: Nov. 17, 2015

(54) DEVICES AND METHODS FOR COMMON ELECTRODE MURA PREVENTION

(71) Applicant: APPLE INC., Cupertino, CA (US)

(72) Inventors: Ahmad Al-Dahle, Santa Clara, CA (US); Hopil Bae, Sunnyvale, CA (US); Sang Y. Youn, Cupertino, CA (US); Yafei Bi, Palo Alto, CA (US); Wei H. Yao, Palo Alto, CA (US); David A. Stronks, San Jose, CA (US)

(73) Assignee: Apple Inc., Cupertino, CA (US)

( * ) Notice: Subject to any disclaimer, the term of this patent is extended or adjusted under 35 U.S.C. 154(b) by 214 days.

(21) Appl. No.: 13/654,242

(22) Filed: Oct. 17, 2012

(65) Prior Publication Data

US 2013/0328847 A1 Dec. 12, 2013

Related U.S. Application Data

(60) Provisional application No. 61/657,696, filed on Jun. 8, 2012.

(51) Int. Cl.
*G09G 5/00* (2006.01)
*G09G 3/20* (2006.01)

(52) U.S. Cl.
CPC ..... *G09G 5/003* (2013.01); *G09G 3/2092* (2013.01); *G09G 2330/027* (2013.01); *G09G 2330/06* (2013.01)

(58) Field of Classification Search
CPC ..... G09G 2300/0426; G09G 2320/0233; G09G 2320/02; G09G 2330/12; G09G 3/006; G09G 3/3655; G09G 2310/0245; G09G 2310/061; G09G 2330/02; G09G 2330/04; G09G 3/3648; G09G 3/3674; G09G 3/3685; G06F 3/0412; G06F 3/044; G06F 2203/04107
USPC ..... 349/149–152; 345/211
See application file for complete search history.

(56) References Cited

U.S. PATENT DOCUMENTS

| | | | | |
|---|---|---|---|---|
| 5,946,057 | A | 8/1999 | Kusanagi | |
| 6,108,057 | A | 8/2000 | Kusanagi | |
| 7,514,713 | B2 | 4/2009 | Tsai et al. | |
| 8,179,643 | B2 | 5/2012 | Moon et al. | |
| 2002/0018059 | A1 * | 2/2002 | Yanagi et al. | 345/204 |
| 2002/0196223 | A1 * | 12/2002 | Takahashi et al. | 345/90 |
| 2003/0043127 | A1 * | 3/2003 | Satoh et al. | 345/204 |
| 2005/0088830 | A1 * | 4/2005 | Yumoto et al. | 361/749 |
| 2006/0158407 | A1 * | 7/2006 | Chen et al. | 345/87 |
| 2008/0100331 | A1 * | 5/2008 | Qi | 324/770 |
| 2008/0272471 | A1 * | 11/2008 | Onodera et al. | 257/668 |
| 2009/0009503 | A1 * | 1/2009 | Tajiri | 345/211 |
| 2010/0123701 | A1 | 5/2010 | Yeo | |
| 2010/0156883 | A1 * | 6/2010 | Yamato et al. | 345/213 |

* cited by examiner

*Primary Examiner* — Sanjiv D Patel
(74) *Attorney, Agent, or Firm* — Fletcher Yoder PC

(57) ABSTRACT

Methods and devices employing mura prevention circuitry, are provided. In one example, a method may include supplying a first voltage pathway between a common electrode driver and a common electrode of an electronic display device and supplying a second voltage pathway between the common electrode driver and ground. Mura prevention circuitry may be supplied that activates the first voltage pathway when the electronic display device is turned on and an activation gate signal is provided from a gate corresponding to the common electrode driver. Further, the mura prevention circuitry may activate the second voltage pathway when the electronic display device is turned off or no activation gate signal is provided from the gate corresponding to the common electrode driver.

23 Claims, 4 Drawing Sheets

DEVICES AND METHODS FOR COMMON ELECTRODE MURA PREVENTION

The present application is a Non-Provisional of U.S. Provisional Patent Application No. 61/657,696, entitled "Devices and Methods for Common Electrode Mura Prevention," filed Jun. 8, 2012, which is herein incorporated by reference.

BACKGROUND

The present disclosure relates generally to electronic displays (e.g., a liquid crystal display (LCD) or organic light-emitting diode (OLED) display) and, more particularly, to electronic displays that can be turned off in a manner that reduces non-uniformity in a display output when the display is subsequently turned back on.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Electronic displays, such as liquid crystal displays (LCDs), are commonly used in electronic devices such as televisions, computers, and phones. LCDs portray images by modulating the amount of light that passes through a liquid crystal layer within pixels of varying color. For example, by varying a voltage difference between a pixel electrode and a common electrode in a pixel, an electric field may result. The electric field may cause the liquid crystal layer to vary its alignment, which may ultimately result in more or less light being emitted through the pixel where it may be seen. By changing the voltage difference (often referred to as a data signal) supplied to each pixel, images may be produced on the LCD.

To store data representing a particular amount of light that is to be passed through pixels, gates of thin-film transistors (TFTs) in the pixels may be activated while the data signal is supplied to the pixels. Conventionally, when an LCD is turned off, the pixel electrodes of all pixels of the LCD may be supplied a minimal voltage. However, when triboelectric charging occurs, such as by friction, (e.g., friction caused by inserting or removing a cable from a cable connector) electrostatic discharge (ESD) may enter the display. As the ESD enters the display, a charge may be left in the display, causing retained charges to the common electrodes of the display. It is believed that these retained charges, caused by the incorporation of ESD in the display, may result in mura or image artifacts, such as undesirable checkerboard patterns that could appear after the display is turned on again.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Embodiments of the present disclosure relate to devices and methods for turning off an electronic display to prevent electro-static discharge (ESD) from causing image artifacts when the display is subsequently turned back on. By way of example, a method for turning off an electronic display may include short-circuiting any electrical charge in each common electrode of an electronic display as the panel is turned off.

Various refinements of the features noted above may be made in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
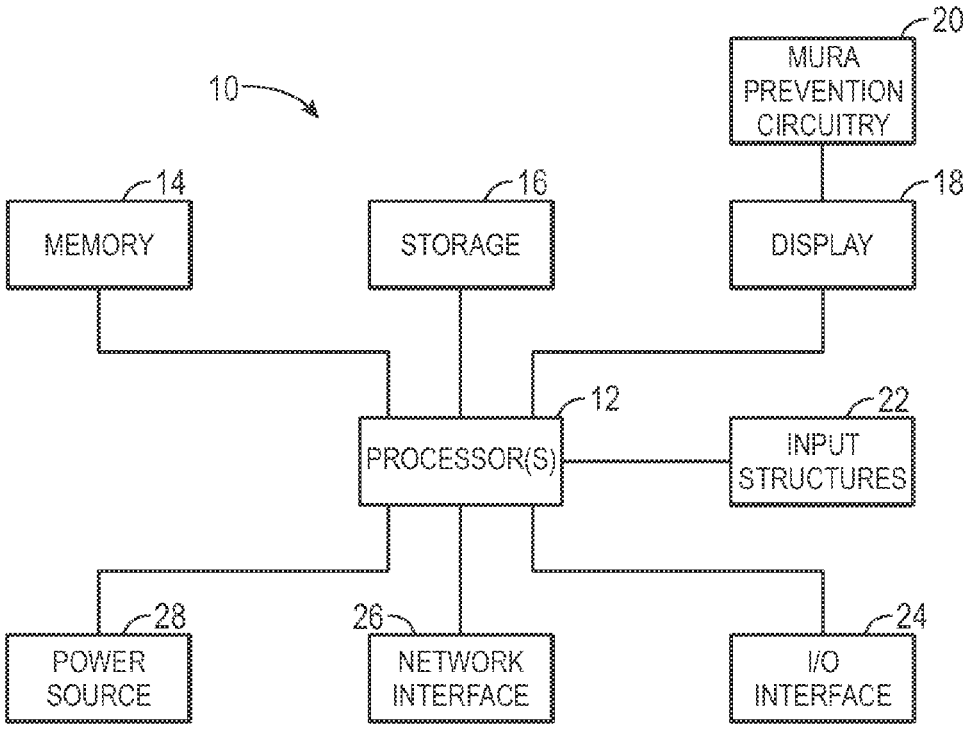
FIG. 1 is a schematic block diagram of an electronic device with a display having mura prevention circuitry, in accordance with an embodiment.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As mentioned above, embodiments of the present disclosure relate to electronic display devices and electronic devices incorporating electronic display devices that employ a display shut-down device, method, or combination thereof. Specifically, rather than turning off an electronic display in a conventional manner, which could result in a retained common voltage charged on the pixels of the electronic display, which could in turn cause image artifacts when the display is turned back on, embodiments of the present disclosure may incorporate mura prevention circuitry. When the electronic display device is turned off, this mura prevention circuitry may result in a significantly reduced amount of residual charge remaining on the common electrodes of the electronic display. In fact, the amount of residual charge remaining on the common electrodes may be so low as to substantially reduce the effect of any image artifacts that might otherwise form.

Specifically, when an electronic display device is turned off, to decrease the amount of residual charge remaining on the common electrodes, each of the common electrodes of the electronic display device may be short-circuited to ground by activating depletion mode MOSFETs along each of the common electrode driver lines. The activation of these depletion mode MOSFETs creates a low resistance path that can enable distribution of any retained charge across all of the display device's common electrodes, creating uniformity in charges across all of the common electrodes.

Figure 2:
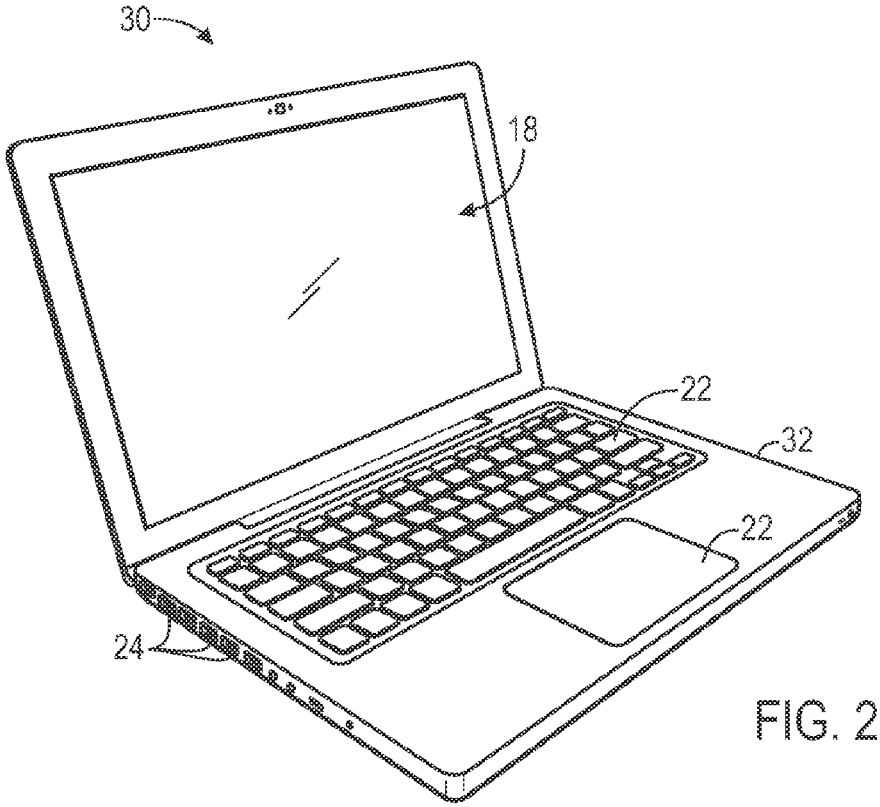
FIG. 2 is a perspective view of a notebook computer representing an embodiment of the electronic device of FIG. 1.
Figure 3:
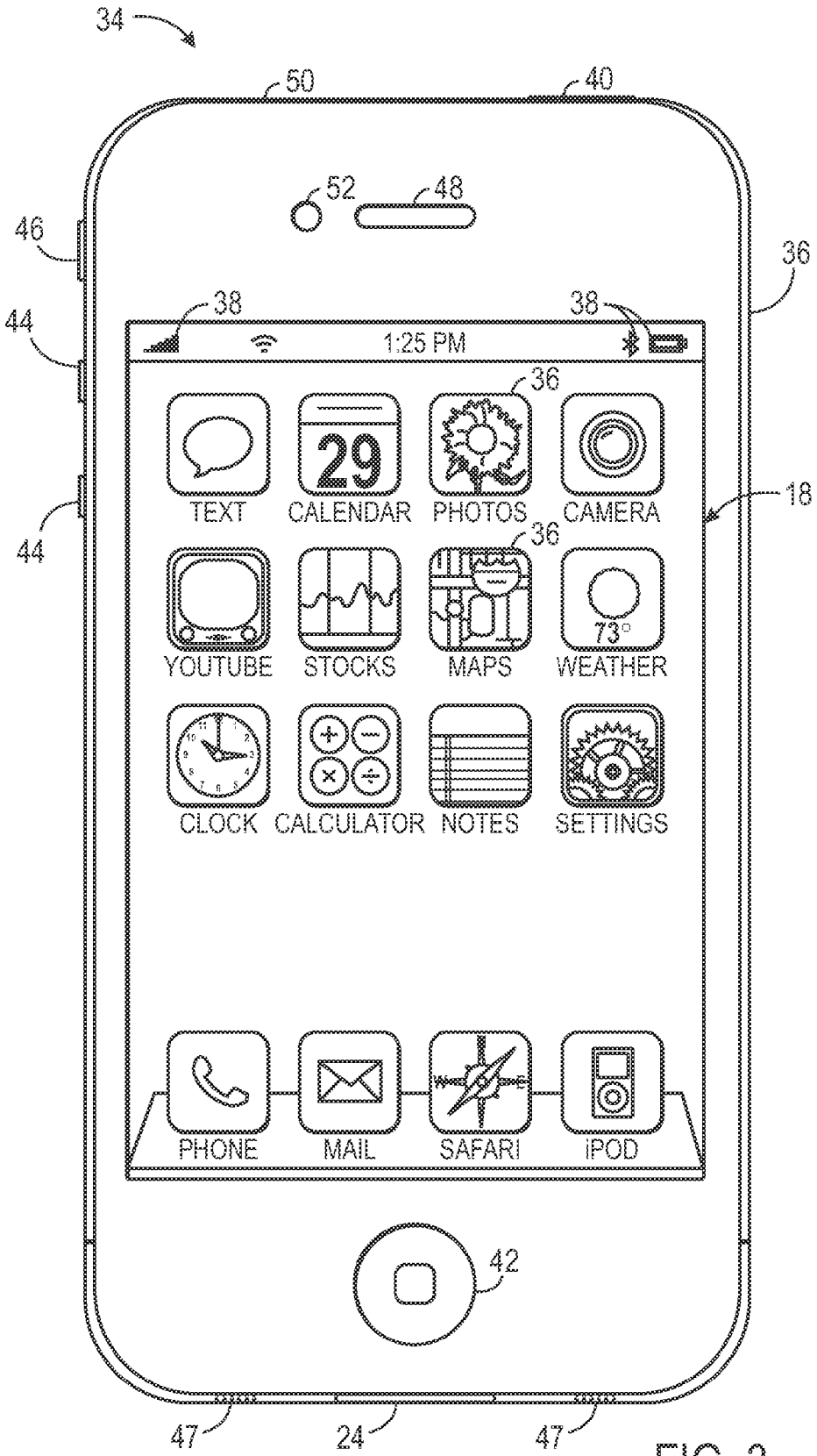
FIG. 3 is a front view of a handheld device representing another embodiment of the electronic device of FIG. 1.

With the foregoing in mind, a general description of suitable electronic devices that may employ electronic displays having mura prevention capabilities will be provided below. In particular, FIG. 1 is a block diagram depicting various components that may be present in an electronic device suitable for use with such a display. FIGS. 2 and 3 respectively illustrate perspective and front views of a suitable electronic device, which may be, as illustrated, a notebook computer or a handheld electronic device.

Turning first to FIG. 1, an electronic device 10 according to an embodiment of the present disclosure may include, among other things, one or more processor(s) 12, memory 14, nonvolatile storage 16, a display 18 with associated mura prevention circuitry 20, input structures 22, an input/output (I/O) interface 24, network interfaces 26, and a power source 28. The various functional blocks shown in FIG. 1 may include hardware elements (including circuitry), software elements (including computer code stored on a computer-readable medium) or a combination of both hardware and software elements. It should be noted that FIG. 1 is merely one example of a particular implementation and is intended to illustrate the types of components that may be present in the electronic device 10.

By way of example, the electronic device 10 may represent a block diagram of the notebook computer depicted in FIG. 2, the handheld device depicted in FIG. 3, or similar devices. It should be noted that the processor(s) 12 and/or other data processing circuitry may be generally referred to herein as "data processing circuitry." This data processing circuitry may be embodied wholly or in part as software, firmware, hardware, or any combination thereof. Furthermore, the data processing circuitry may be a single contained processing module or may be incorporated wholly or partially within any of the other elements within the electronic device 10. As presented herein, the data processing circuitry may control the electronic display 18 by determining when the electronic display 18 is to be turned off and by issuing a turn-off or shutdown command. The turn-off or shutdown command is provided to the display 18, which uses the mura prevention circuitry 20 to turn off the display 18 in a way that reduces the occurrence of image artifacts when the display 18 is later turned back on.

In the electronic device 10 of FIG. 1, the processor(s) 12 and/or other data processing circuitry may be operably coupled with the memory 14 and the nonvolatile memory 16 to execute instructions. Such programs or instructions executed by the processor(s) 12 may be stored in any suitable article of manufacture that includes one or more tangible, computer-readable media at least collectively storing the instructions or routines, such as the memory 14 and the nonvolatile storage 16. The memory 14 and the nonvolatile storage 16 may include any suitable articles of manufacture for storing data and executable instructions, such as random-access memory, read-only memory, rewritable flash memory, hard drives, and optical discs. Also, programs (e.g., an operating system) encoded on such a computer program product may also include instructions that may be executed by the processor(s) 12.

The display 18 may be a touch-screen liquid crystal display (LCD) or organic light-emitting diode (OLED) display, for example, which may enable users to interact with a user interface of the electronic device 10. In some embodiments, the electronic display 18 may be a MultiTouch™ display that can detect multiple touches at once. Various display components, such as turn-off logic and associated switching devices may be located within the electronic display 18. As will be described further below, the mura prevention circuitry 20 may include circuitry for creating a low resistance path from the common electrode drivers of the display 18 to ground when the display 18 is turned off. This low resistance path to ground may enable any retained charges found in the common electrodes to dissipate, resulting in more uniform display 18 outputs when the display 18 is turned back on.

The input structures 22 of the electronic device 10 may enable a user to interact with the electronic device 10 (e.g., pressing a button to increase or decrease a volume level). The I/O interface 24 may enable electronic device 10 to interface with various other electronic devices, as may the network interfaces 26. The network interfaces 26 may include, for example, interfaces for a personal area network (PAN), such as a Bluetooth network, for a local area network (LAN), such as an 802.11x Wi-Fi network, and/or for a wide area network (WAN), such as a 3G or 4G cellular network. The power source 28 of the electronic device 10 may be any suitable source of power, such as a rechargeable lithium polymer (Li-poly) battery and/or an alternating current (AC) power converter.

The electronic device 10 may take the form of a computer or other type of electronic device. Such computers may include computers that are generally portable (such as laptop, notebook, and tablet computers) as well as computers that are generally used in one place (such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 30, is illustrated in FIG. 2 in accordance with one embodiment of the present disclosure. The depicted computer 30 may include a housing 32, a display 18, input structures 22, and ports of an I/O interface 24. In one embodiment, the input structures 22 (such as a keyboard and/or touchpad) may be used to interact with the computer 30, such as to start, control, or operate a GUI or applications running on computer 30. For example, a keyboard and/or touchpad may allow a user to navigate a user interface or application interface displayed on the display 18. Further, the display 18 may include the zero-bias display turn-off circuitry 20.

FIG. 3 depicts a front view of a handheld device 34, which represents one embodiment of the electronic device 10. The handheld device 34 may represent, for example, a portable phone, a media player, a personal data organizer, a handheld game platform, or any combination of such devices. By way of example, the handheld device 34 may be a model of an iPod® or iPhone® available from Apple Inc. of Cupertino, Calif. In other embodiments, the handheld device 34 may be a tablet-sized embodiment of the electronic device 10, which may be, for example, a model of an iPad® available from Apple Inc.

The handheld device 34 may include an enclosure 36 to protect interior components from physical damage and to shield them from electromagnetic interference. The enclosure 36 may surround the display 18, which may display indicator icons 38. The indicator icons 38 may indicate, among other things, a cellular signal strength, Bluetooth connection, and/or battery life. The I/O interfaces 24 may open through the enclosure 36 and may include, for example, a proprietary I/O port from Apple Inc. to connect to external devices.

User input structures 40, 42, 44, and 46, in combination with the display 18, may allow a user to control the handheld device 34. For example, the input structure 40 may activate or deactivate the handheld device 34, the input structure 42 may navigate a user interface to a home screen, a user-configurable application screen, and/or activate a voice-recognition feature of the handheld device 34, the input structures 44 may provide volume control, and the input structure 46 may toggle between vibrate and ring modes. A microphone 48 may obtain a user's voice for various voice-related features, and a speaker 50 may enable audio playback and/or certain phone capabilities. A headphone input 52 may provide a connection to external speakers and/or headphones.

Figure 4:
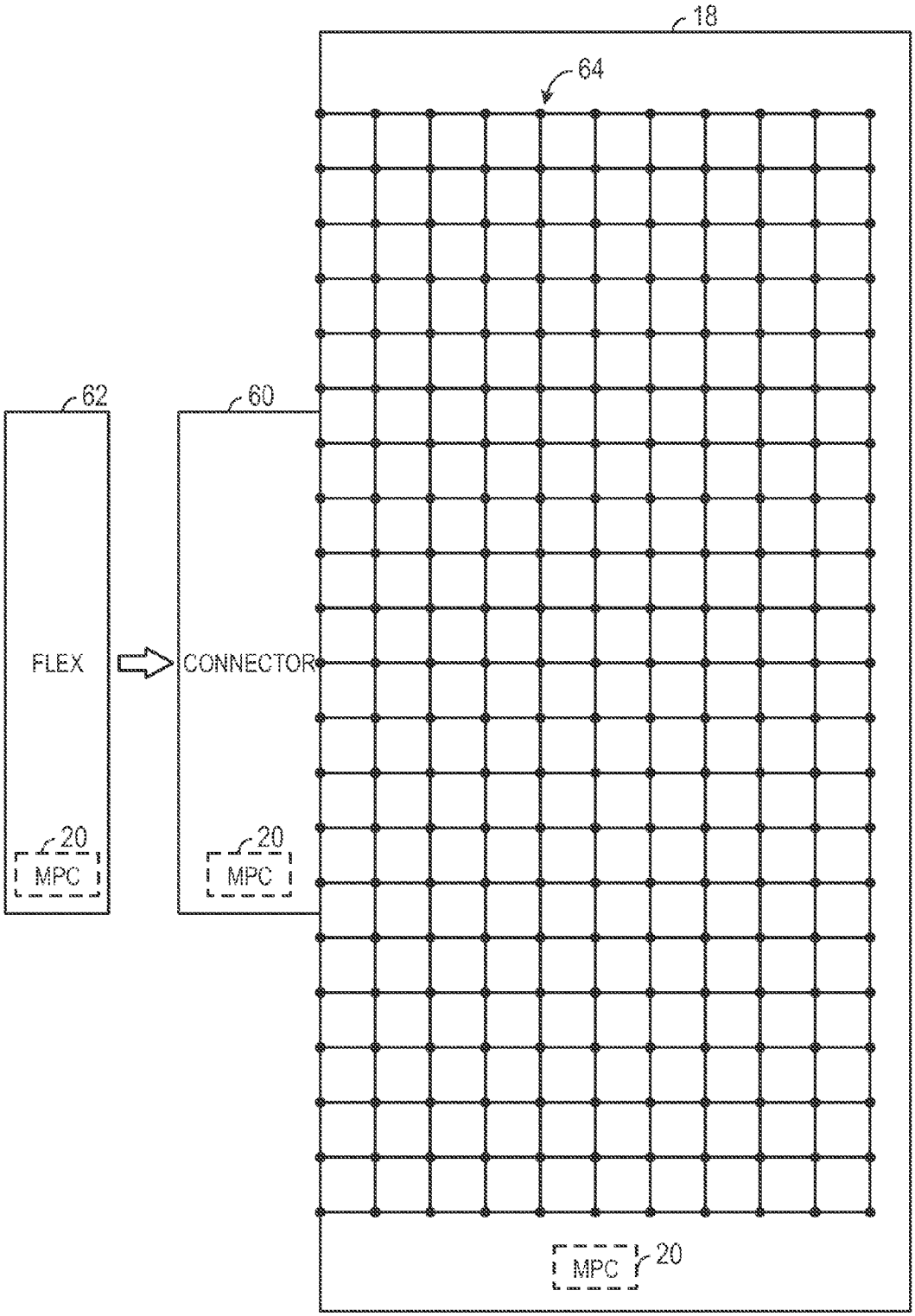
FIG. 4 is a schematic diagram illustrating a connection between a display and flex circuitry that utilizes mura prevention circuitry, in accordance with an embodiment.

As mentioned above, the display 18 of the handheld device 34 may make use of the mura prevention circuitry 20. FIG. 4 illustrates a connector 60 that electrically couples and conntects a display 18 with flex circuitry 62. In certain embodiments, the flex circuitry 62 may be a main logic board (e.g., main logic board 100 of FIG. 5) or may be coupling circuitry that couples a main logic board to a display 18. For example, the flex circuitry 62 may provide voltages through the connector 60 to one or more common electrodes (e.g., the 20×10 common electrode matrix 64 depicted in FIG. 4) of the display 18. As previously mentioned, whenever a flex circuit 62 is connected to or disconnected from the display 18 (e.g., via the connector 60), electro-static discharge may enter the display 18. This electro-static discharge may result in stored charges among the common electrodes. These stored charges may induce patterns or other uniformities in the display 18 outputs.

As discussed above, the display 18 may make use of mura prevention circuitry 20. As illustrated by the dashed boxes, the mura prevention circuitry 20 may reside in, for example, the flex circuitry 62, the connector 60, or the display 18. As will be discussed in more detail with regards to FIG. 5, the mura prevention circuitry 20 may enable more uniform display 18 outputs by distributing and/or depleting any charges that may be stored in the common electrodes 64 of the display 18.

Figure 5:
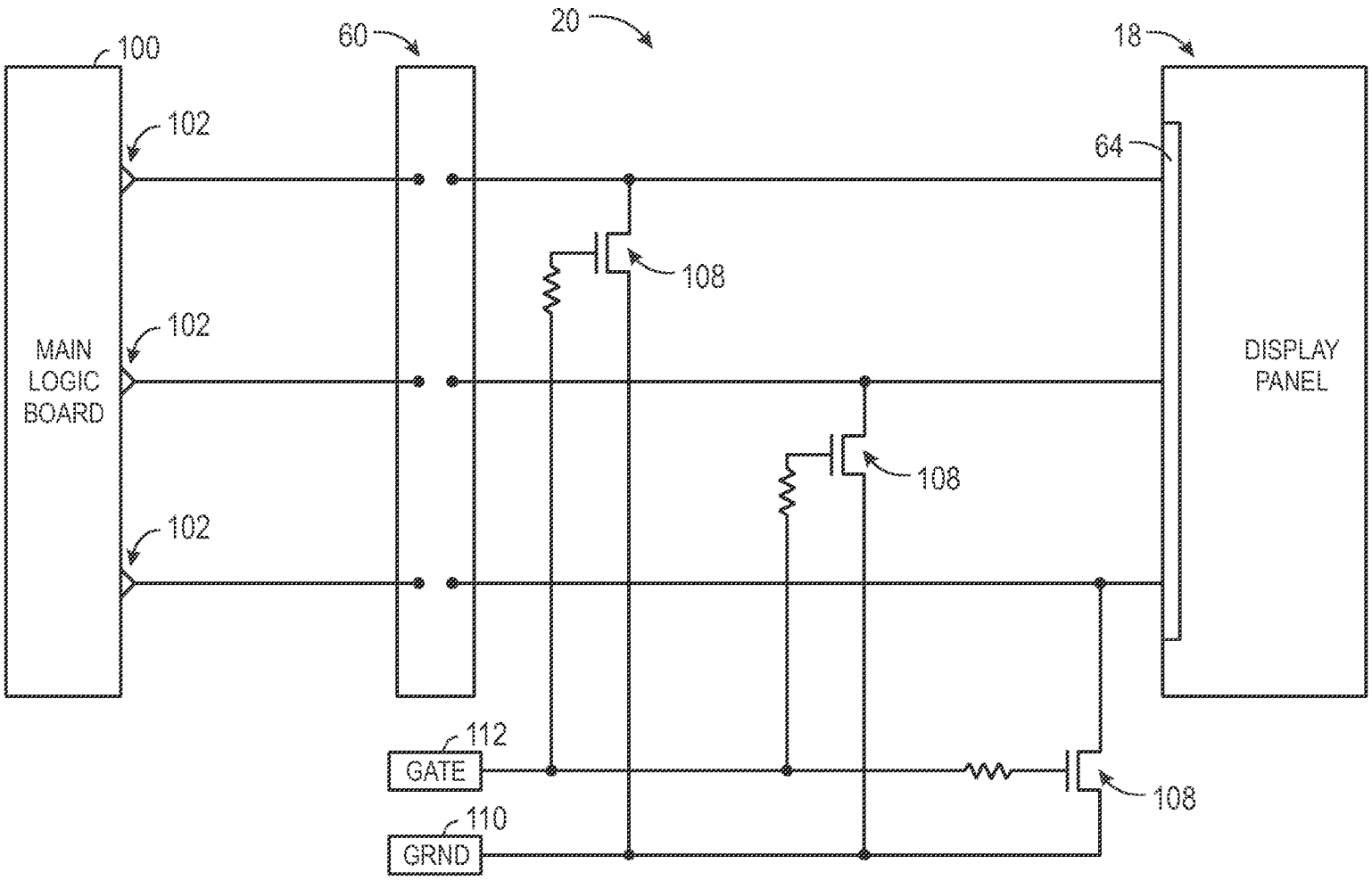
FIG. 5 is a circuit diagram of mura prevention circuitry, in accordance with an embodiment.

Turning now to a more detailed discussion of the mura prevention circuitry, FIG. 5 illustrates a circuit diagram of the mura prevention circuitry 20 electrically coupled to the display 18, in accordance with an embodiment. As discussed above, the mura prevention circuitry 20 may be found in any one of a multitude of areas of circuitry. For example, the mura prevention circuitry 20 may be found in either the display 18, the connector 60, or the flex circuitry 62. As illustrated, a main logic board (MLB) 100 may provide one or more common electrode (VCOM) drivers 102. When electrically coupled with the display 18, the VCOM drivers 102 may provide voltage signals to one or more (e.g., an array) of VCOMs 64 of the display 18. In certain embodiments, the MLB 100 or coupling circuitry may be a flex circuit that enables the MLB 100 to flex due to mounting of the MLB 100 circuitry on a flexible substrate. The MLB 100 may electrically couple with the display 18 via a connector, such as a board-to-board (B2B) connector 60.

The mura prevention circuitry 20 may include metal-oxide-semicondutor field-effect transistors (MOSFETs), such as n-channel depletion mode MOSFETs 108. The MOSFETs 108 may provide an electrical connection between the coupled VCOM drivers 102 and ground 110. A gate signal 112 may determine whether signals from the VCOM drivers 102 will reach the ground 110 or the VCOMs 103 of the display 18. Generally speaking, depletion mode MOSFETs 108 are normally closed, allowing voltage to pass through the MOSFETs 108, until a gate activation signal (e.g., gate signal 112) is provided to the n-channel depletion mode MOSFETs 108. Thus, when no signal is provided via the gate signal 112 (e.g., when an electronic display device 18 is turned off), the VCOM driver 102 signals will flow to the ground 110. However, when a gate signal 112 is applied to the n-channel depletion mode MOSFETs 108 (e.g., when the electronic display device 18 is turned on and a gate activation signal 112 is present), the VCOM driver 102 signals will flow to the VCOMs 64 of the display 18. Accordingly, when the display 18 is turned off or no gate activation signal 112 is provided, any charge retained by the VCOMs 64 may flow to ground 110, thus reducing any image artifacts that may be caused by such retained charges in the VCOMs 64. Accordingly, any induced charges due to electro-static discharge occurring while the display 18 is off will also be dissipated since in the MOSFETs 108 may always be closed while the display is off.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A method comprising:

supplying a first voltage pathway between a common electrode driver and a common electrode of an electronic display device;

supplying a second voltage pathway between the common electrode driver and ground; and using mura prevention circuitry configured to:

activate the first voltage pathway when the electronic display device is turned on and as long as a gate signal is provided to a gate of a switch of the second voltage pathway; and activate the second voltage pathway when the electronic display device is turned off, wherein turning off the electronic display device causes the gate signal to be turned off, wherein turning off of the gate signal causes the switch of the second voltage pathway to activate the second voltage pathway.

2. The method of claim 1, wherein the mura prevention circuitry is configured to activate the first voltage pathway by providing a voltage supply to a switch and is configured to activate the second voltage pathway comprises removing the voltage supply from the switch.

3. The method of claim 1, wherein the mura prevention circuitry is configured to activate the first voltage pathway or activating the second voltage pathway comprises using one or more metal-oxide-semicondutor field-effect transistors (MOSFETs) to activate the first voltage pathway or the second voltage pathway.

4. The method of claim 1, comprising supplying the mura prevention circuitry in flex circuitry configured to supply the first and second voltage pathways.

5. The method of claim 1, comprising supplying the mura prevention circuitry in a connector configured to electrically couple a flex circuitry with the electronic display device.

6. The method of claim 1, comprising supplying the mura prevention circuitry in the electronic display device.

7. An electronic device, comprising:

a processor configured to provide image data;

a display configured to present the image data, comprising one or more common electrodes;

a common electrode driver configured to supply common voltage outputs to the common electrodes; and mura prevention circuitry configured to:

activate a first voltage pathway between the common electrode driver and the common electrodes of the display when the display is turned on and as long as a gate signal is provided to a gate of a switch of a second voltage pathway between the common electrode driver and ground; and activate the second voltage pathway when the display is turned off, wherein turning off the electronic display device causes the gate signal to be turned off, wherein turning off of the gate signal causes the switch of the second voltage pathway to activate the second voltage pathway.

8. The electronic device of claim 7, comprising flex circuitry configured to provide signals from the common electrode driver to the display, wherein the flex circuitry comprises the mura prevention circuitry.

9. The electronic device of claim 7, comprising:

flex circuitry configured to provide signals from the common electrode driver to the display; and a connector configured to enable electrical coupling between the flex circuitry and the display, wherein the connector comprises the mura prevention circuitry.

10. The electronic device of claim 7, wherein the display comprises the mura prevention circuitry.

11. The electronic device of claim 7, wherein the mura correction circuitry comprises:

one first voltage pathway for each common electrode of the display;

one second voltage pathway for each common electrode of the display; and one depletion mode MOSFET for each common electrode of the display, wherein the depletion mode MOSFET determines which of the first or second voltage pathways are activated.

12. Mura prevention circuitry, configured to:

activate a first voltage pathway configured to deliver a voltage between a common electrode driver and a common electrode of an electronic display device when the electronic display device is turned on and as long as a gate signal is provided to a gate of a switch of a second voltage pathway between the common electrode driver and ground; and activate the second voltage pathway when the electronic display device is turned off, wherein turning off of the electronic display device causes the gate signal to be turned off, wherein turning off of the gate signal causes the switch of the second voltage pathway to activate the second voltage pathway.

13. The mura prevention circuitry of claim 12, comprising at least one MOSFET, wherein the at least one MOSFET activates either the first and second voltage pathway.

14. The mura prevention circuitry of claim 12, comprising at least one depletion mode MOSFET configured to activate the second voltage pathway when no voltage is provided to a gate of the depletion mode MOSFET.

15. The mura prevention circuitry of claim 12, comprising at least one depletion mode MOSFET configured to activate the first voltage pathway when a voltage is provided to a gate of the depletion mode MOSFET.

16. The mura prevention circuitry of claim 12, comprising a gate input configured to provide gate signals that affect whether the first or second voltage pathway is activated.

17. The mura prevention circuitry of claim 12, wherein the mura prevention circuitry comprises flex circuitry.

18. The mura prevention circuitry of claim 12, wherein the mura prevention circuitry comprises a connector configured to electrical components.

19. The mura prevention circuitry of claim 12, wherein the mura prevention circuitry is disposed in the electronic display device.

20. The mura prevention circuitry of claim 12, wherein the mura prevention circuitry is configured to dissipate any induced charges due to electro-static discharge occurring while the electronic display device is off.

21. The mura prevention circuitry of claim 12, wherein:

the electronic device display comprises a plurality of common electrodes and one depletion mode MOSFET for each common electrode of the electronic display device.

22. An electronic display device; comprising:

a plurality of common electrodes;

at least one common electrode driver configured to supply common voltage outputs to the common electrodes; and mura prevention circuitry comprising a depletion-mode metal-oxide- semiconductor field-effect transistor (MOSFET) coupling each of the plurality of common electrodes to ground, wherein the mura prevention circuitry is configured to short-circuit any electrical charge in each of the common electrodes when the electronic display device is turned off, wherein turning off the electronic display device causes a gate signal from the depletion-mode MOSFET to be turned off, such that a gate of the depletion-mode MOSFET between the at least one common electrode driver and ground is closed, causing any signals generated by the at least one common electrode driver to flow to ground.

23. A method comprising:

providing at least one common voltage output to a plurality of common electrodes of a display; and short-circuiting any electro-static discharge retained by the common electrodes when the display is turned off, wherein turning off the display causes a gate signal from a depletion-mode metal-oxide-semiconductor field-effect transistor (MOSFET) coupling the common electrodes and ground to be turned off, such that a gate of the depletion-mode MOSFET between the at least one common electrode driver and ground is closed, causing any signals generated by the at least one common electrode driver to flow to ground.

* * * * *